US008508204B2

(12) United States Patent
Deurenberg et al.

(10) Patent No.: US 8,508,204 B2
(45) Date of Patent: Aug. 13, 2013

(54) CONTROLLER AND METHOD OF OPERATING A CONTROLLER

(75) Inventors: Peter H. F. Deurenberg, S-Hertogenbosch (NL); Gert Van Der Horn, Delft (NL)

(73) Assignee: NXP B.V., Eindhoven (NL)

( * ) Notice: Subject to any disclaimer, the term of this patent is extended or adjusted under 35 U.S.C. 154(b) by 392 days.

(21) Appl. No.: 12/933,411

(22) PCT Filed: Mar. 17, 2009

(86) PCT No.: PCT/IB2009/051128

§ 371 (c)(1),
(2), (4) Date: Sep. 18, 2010

(87) PCT Pub. No.: WO2009/115987

PCT Pub. Date: Sep. 24, 2009

(65) Prior Publication Data

US 2011/0031900 A1 Feb. 10, 2011

(30) Foreign Application Priority Data

Mar. 19, 2008 (EP) ..... 08102752

(51) Int. Cl.
*G05F 1/40* (2006.01)

(52) U.S. Cl.
USPC ..... 323/282

(58) Field of Classification Search
USPC ..... 315/209 R, 210, 224, 291, 294, 302, 315/307, 312; 323/238, 242, 282–284
See application file for complete search history.

(56) References Cited

U.S. PATENT DOCUMENTS

| | | | | |
|---|---|---|---|---|
| 6,204,650 | B1 * | 3/2001 | Shimamori | 323/283 |
| 6,894,471 | B2 * | 5/2005 | Corva et al. | 323/282 |
| 7,545,130 | B2 * | 6/2009 | Latham | 323/283 |
| 7,760,520 | B2 * | 7/2010 | Jang et al. | 363/21.18 |
| 7,888,922 | B2 * | 2/2011 | Melanson | 323/282 |
| 8,134,305 | B2 * | 3/2012 | Keh et al. | 315/291 |
| 8,193,795 | B2 * | 6/2012 | Zhou et al. | 323/283 |
| 2006/0192728 | A1 | 8/2006 | Kim | |
| 2008/0001547 | A1 * | 1/2008 | Negru | 315/189 |
| 2008/0278132 | A1 * | 11/2008 | Kesterson et al. | 323/283 |
| 2011/0109247 | A1 * | 5/2011 | Hoogzaad et al. | 315/294 |

FOREIGN PATENT DOCUMENTS

| | | | |
|---|---|---|---|
| JP | 2002 238152 | A | 8/2002 |
| WO | 2004/100612 | A1 | 11/2004 |
| WO | 2006080365 | A1 | 8/2006 |
| WO | 2007069200 | A1 | 6/2007 |

* cited by examiner

*Primary Examiner* — Tung X Le

(57) ABSTRACT

A controller for controlling a power generator circuit, and a method for operation such a controller, is disclosed. The invention is particularly suited to LED current generators. The current generator may be switched off to conserve power when not required for any LED circuits. The method relates to determining the time at which the controller is required to provide power, current or voltage, and to adjust the timing of switching-on of the controller, in order to ensure that power, current or voltage is available for the load when required.

20 Claims, 6 Drawing Sheets

CONTROLLER AND METHOD OF OPERATING A CONTROLLER

FIELD OF THE INVENTION

This invention relates to a controller for controlling a power generator circuit, and a method of controlling such a controller. It has application in particular in, but not limited to, controllers for controlling LED current generators.

BACKGROUND OF THE INVENTION

Power supply circuits are known for multicolour LED systems wherein a single LED current generator is connected to a plurality of subsets of LEDs. The LEDs may, for example, have different colours. In order to control the brightness of the different colour LEDs, and therefore the overall appearance of the LED display, the subsets of LEDs are driven with different levels of power. This may be conveniently done by supplying each subset of LEDs with a pulse modulated signal. The pulse modulated signals are typically provided by a current generator. The current generator must be able to supply sufficient power to multiple subsets of LEDs when the pulse modulated signals have overlapping on-times; conversely, there may be periods during which the pulse modulated signals have overlapping off-times: at these overlapping off-times, the current generator is not required to provide power.

Pulse modulation of the individual subsets of LEDs is conveniently effected through the provision of bypass switches. Thus, an individual subset of LEDs is powered when the associated bypass switch is open; however, when the associated bypass switch is closed the signal bypasses the subset of LEDs, which are in consequence not operational. Such bypass switches are disclosed, for instance, in PCT patent application publication WO2007/069200.

In order to improve the overall efficiency of the power supply, it is known to switch off the current generator during periods when all the bypass switches are closed and thus no current is required by the load. PCT patent application publication number WO2006/080365 discloses a power supply providing non-overlapping pulse modulated signals to multiple subsets of LEDs, in which the current generator is disabled during a non-light-emission period when none of the light emitting diodes are driven by the drive controller. Such a circuit has the disadvantage that, when the current is required, the generator has a non-zero rise time for the current. In other words, during the period when the current is first required by one of the subsets of LEDs, the current generator can only provide a fraction of the required current. This results in a noticeable dimming, or flicker, of the LED light source display.

SUMMARY OF THE INVENTION

It is an object of the current invention to provide an improved controller and method of operating such a controller.

According to the present invention there is provided a method of operating a controller, the controller being for controlling a power generator circuit for supplying power to a pulse modulated signal, the pulse modulated signal being for driving a load, the load being switchable by means of a switch, which controller has a cycle with a period corresponding to the sum of an off-time and an on-time, the power generator circuit being arranged to start to switch off at the start of the off-time, and to start to switch on at the start of the on-time, the method comprising the steps of: (a) monitoring a rate of change of output power of the power generator circuit at a time when it is ramping up from an off-state to an on-state (b) determining a lead-time from the rate of change of output power, (c) storing the determined lead-time, and (d) adjusting at least one of the off-time and the on-time of the controller in dependence on the stored lead-time. Advantageously, this enables the controller to provide the required LED current immediately the associated bypass switch is opened. Since the ramp-up lead time required by the current generator depends heavily on the particular application settings, such as inductance, switching frequency, input-output voltages, no fixed value is determined for the ramp-up lead time a priori. Although it would be possible to provide a preset ramp-up lead time, this would lead to either a reduction of the efficiency gain to be had by switching off the current generator, or some level of delayed start up.

Thus far, the invention and the background to the invention have been described with respect to current generators and bypass switches. However, the invention also embraces controllers wherein the power generator is a voltage generator, the step of monitoring a rate of change of output power comprises monitoring a rate of change of output voltage, and the switch comprises a circuit-breaker switch. More commonly, though, the power generator will be a current generator, the step of monitoring a rate of change of output power comprises monitoring a rate of change of output current and the switch comprises a bypass switch.

Preferably the, or each, load is an LED channel; however, alternative loads such as electrode luminescent displays are also covered by the invention.

Advantageously step (a) comprises monitoring a voltage across a sense resistor. This provides a particularly convenient method of determining a current signal.

Preferably the off time initially is related to and may correspond to a no-load time, which no-load time is the time during which the or each pulse modulated signals are off such that the or each load is zero. Alternatively the off-time initially may correspond to the no-load time reduced by a predetermined default lead time. Provision of such a default or start up lead time may conveniently enable the controller to quickly settle.

Advantageously, in step (b) the lead-time is determined by dividing a predetermined operating current level by the rate of change of current. Thus the controller is easily able to determine a suitable lead-time.

Preferably step (d) comprises advancing the start of the on-time in dependence on the stored lead-time. The start of the on-time may be advanced by an amount that depends on the stored lead-time, or which may correspond exactly to the stored lead-time.

In an alternative embodiment step (d) may comprise delaying the start of the off-time in dependence on, or by an amount equal to, the stored lead time and the method may further comprise delaying the switching of the or each bypass switch in dependence on, or by the amount of, the stored lead time. In either of these two embodiments the off-time of the current generator is reduced by an amount which depends on the lead-time which has been calculated from the controller in its operating condition.

Preferably step (b) comprises increasing a counter from a base value, by means of a clock running at a fixed frequency, throughout the period of ramp-up from the off-state to the on-state, and step (c) comprises storing a value determined from the counter value in a memory. Alternatively step (b) may comprise charging a first capacitor from a predetermined current source, and step (c) may comprise storing, in the first or a further capacitor, the charge in the first capacitor resulting from step (b). Alternatively, step (c) may comprise storing, in a digital register, a signal which relates to the charge in the first capacitor resulting from step (b). Thus the determination of the lead-time may be effected by digital or by analogue means; either digital or analogue means can provide convenient methods of implementation.

In a further aspect of the invention there is provided an integrated circuit for controlling a power generating circuit, comprising a controller configured to operate a method as described above. The integrated circuit may further comprise a power generating circuit for supplying power to one or a plurality of pulse modulated signals, and may be part of an LED driver.

These and other aspects of the invention will be apparent from, and elucidated with reference to, the embodiments described hereinafter.

BRIEF DESCRIPTION OF DRAWINGS

Embodiments of the invention will be described, by way of example only, with reference to the drawings, in which.

Figure 1:
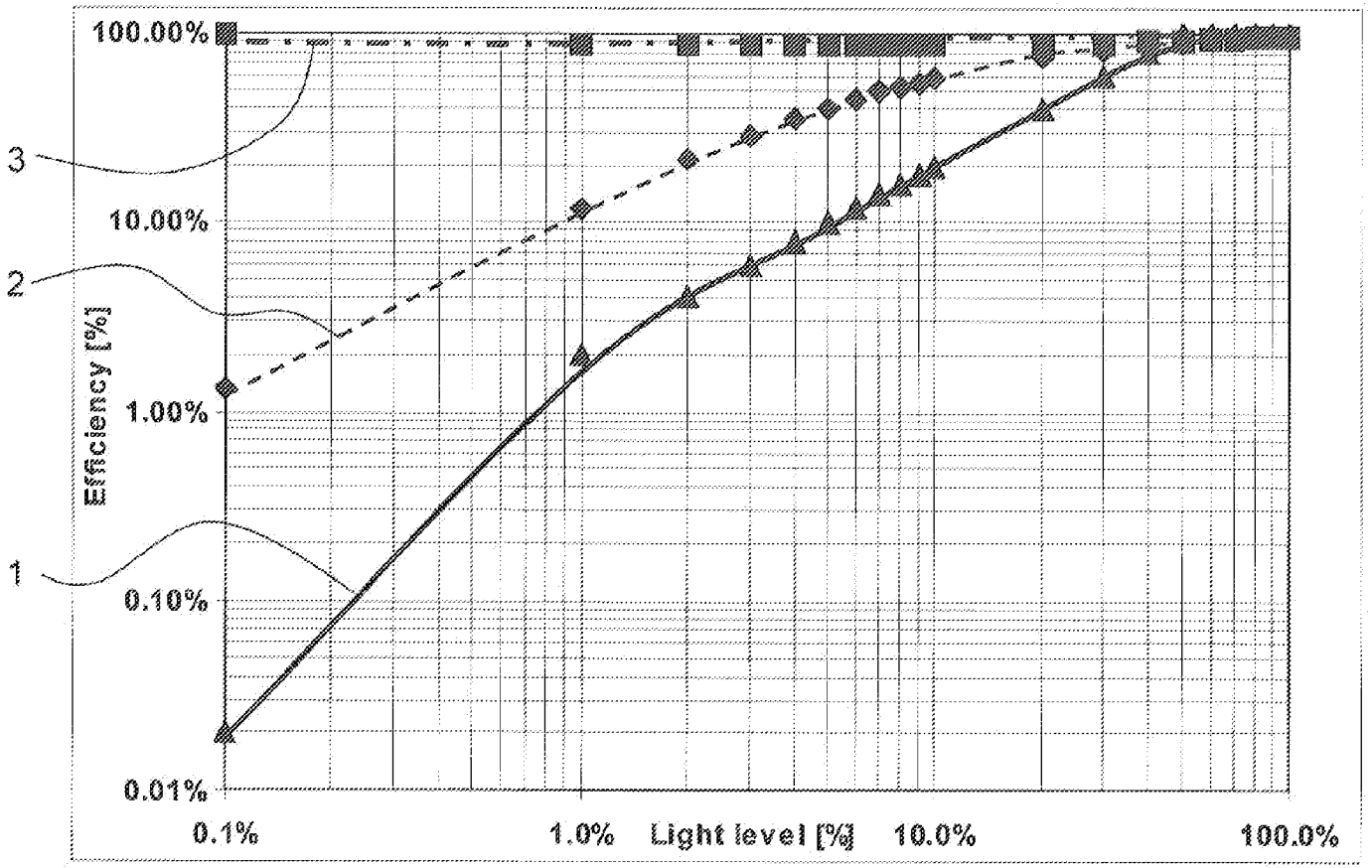
FIG. 1 illustrates the decreasing efficiency with decreasing light level of an LED display circuit.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar feature in modified and different embodiments

DETAILED DESCRIPTION OF EMBODIMENTS

FIG. 1 illustrates the savings in efficiency which may be made by switching off a current generator during the no load periods of an LED drive circuit. The figure shows a calculation for a system in which two bypass switches are connected to a single current source. The efficiency of the system is plotted against the light level. In this example the two pulse modulated signals applied to the two bypass switches are 50% out of phase (corresponding to a worse-case situation). Curve 1 indicates the percentage of the PWM (Pulse Width Modulation) duty cycle for which the current source needs to be switched on. Curve 2 shows the efficiency of a system in which the current source is not switched off in the no-load situation; this may be compared with curve 3 which shows the efficiency of a system where the current generator is switched off when not required. From the figure it is clear that at a 1% light level turning off the converter increases the system efficiency in this example from below 15% to above 80%.

Figure 2:
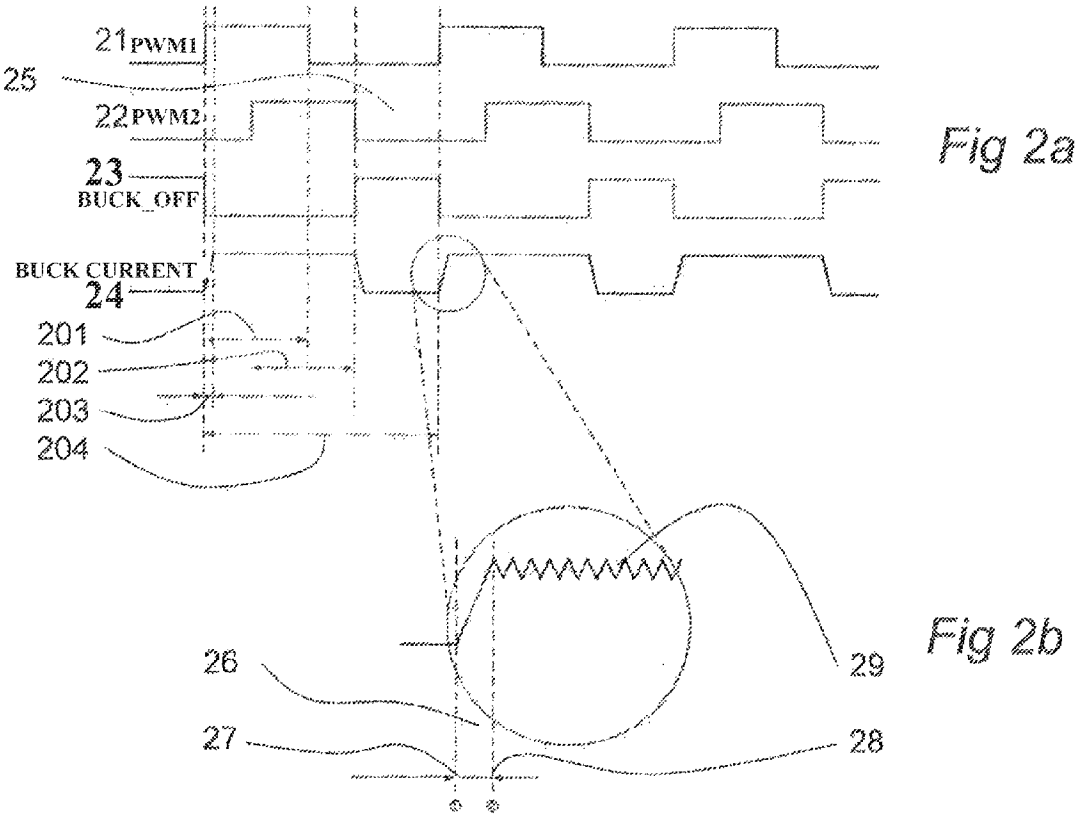
FIG. 2 illustrates pulse modulated signals and current generator control signal and current generator output signal for an LED drive circuit.

Turning now to FIG. 2 this depicts various signals in a system in which the current generator is switched off when not required. FIG. 2 shows two PWM signals 21, 22 in time. The phase of the PWM signals is different. Note that in this application the modulated signals are Pulse Width Modulated signals. Alternatively, Pulse Frequency Modulation (PFM) signals or a combination of PFM and PWM signals may be used.

In this example application, the PWM signals are used to drive two LED channels. The two LED channels are connected to a single current source via two bypass switches. In order to provide the PWM signals to the LED channels, the bypass switches are driven with the inverted PWM signal. As shown at 25 both bypass switches are conducting for a part of the PWM period and during this period the current generator can be turned off. The times at which the current generator may be turned off are shown in signal 23. That is to say, signal 23 is high when the current generator is not required and low when the current generator is required. Thus this signal 23 is found as a logical NOR of the two PWM signals 21 and 22. Signal 24 shows the current which would be output from a practical current generator when controlled under the signal 23. As shown in the figure, when the current source has been turned off and either of the bypass switches stops conducting, the current through the LED is not instantaneously at the correct level, but takes some time to ramp up to this level. The enlarged section of FIG. 2*a* shown in FIG. 2*b* more clearly illustrates the ramp up time 26 of the current source. The ramp up time 26 is the time between the moment 27 when the current generator is switched on, and the moment 28 when it reaches the required current level. When the current generator is providing current at the required level, there is still some ripple 29 on the signal. The nature and magnitude of this ripple depends on the design of the current generator: conveniently a buck converter is used.

As already discussed it is desirable that the current ramp up should not effect the light output; to achieve this, the current generator needs to be turned on earlier.

Figure 3:
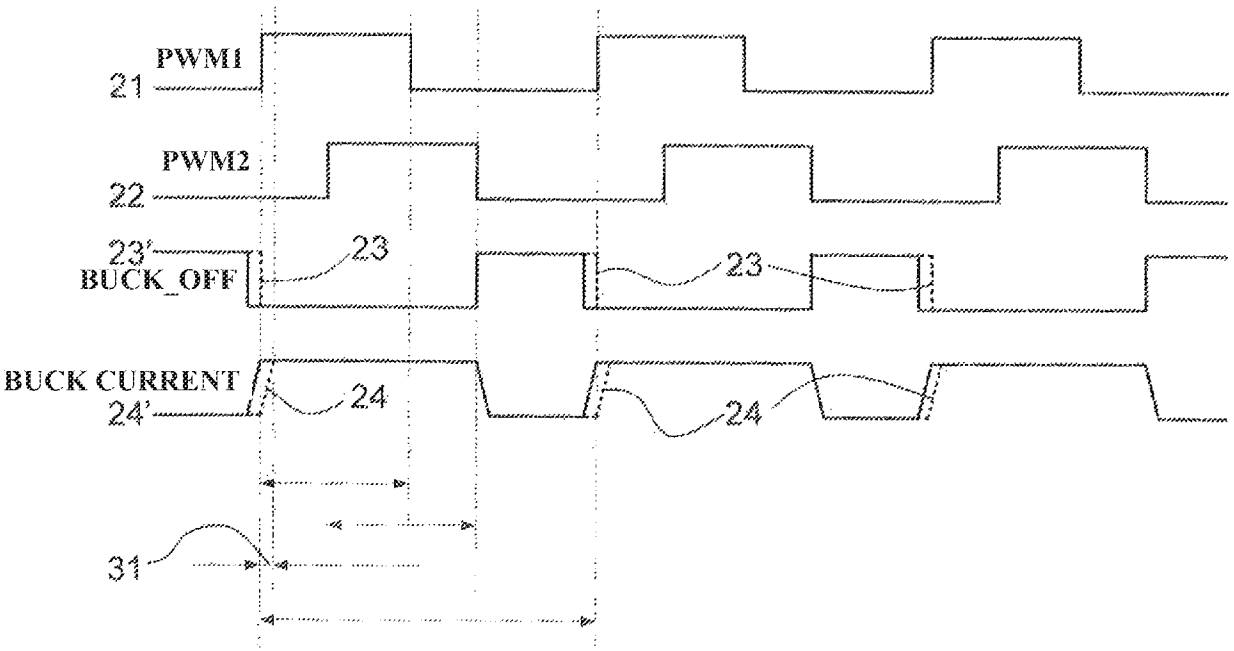
FIG. 3 illustrates the equivalent signals for a first embodiment of the present invention.

FIG. 3 illustrates a first embodiment of the present invention. In this embodiment the phase of the falling edge of the control signal 23' is adjusted such that there is a ramp up lead-time for the current source.

FIG. 3 illustrates the same two PWM signals 21 and 22 as shown in FIG. 2, together with the control signal 23' for switching off the current generator. The hashed line 23 illustrates the control signal without the adjustment for the ramp up lead-time, that is, according to conventional method of control, and the solid line 23' shows the control signal for switching off the current generator including the ramp up lead-time, that is, according to this illustrative embodiment of the invention. The output current from the current generator including the adjustment to the ramp up lead-time is shown in signal 24' (solid line) and that without the adjustment to the lead time is shown in the dashed line 24. As is clear from signal 24', the lead-time required corresponds to the time that the current takes to ramp up from the no-load situation to the desired current level.

Determination of this lead-time, or phase shift, is based on the previous PWM cycles. So, should conditions such as the required LED current change, the ramp up time changes and the lead-time for that cycle will not be correct. However, in the embodiment of the invention the system will detect the new ramp up time automatically and adjust the phase shift of the current generator control signal for the subsequent PWM cycles.

As just described the controller determines the lead-time based on previous PWM cycles. The initial value for the lead-time thus has to be pre-set. This may be achieved in several different ways. In a first method the first few PWM cycles are generated with a ramp up lead-time that is set shorter than would be expected. As a result the LED light output is not correct at the set value for the first few cycles, but slightly lower. As a result of this method there will thus be a small optical deviation. In a second method, the default ramp up lead-time is set to be very conservative; in this method there will be no observable optical effect, but the power saving will not be optimal for the first few PWM cycles. In a third method, an initial value for the ramp up lead-time is determined by observing the output current ramp up over time when the converter is first turned on. By keeping the LED bypass switches conducting during this ramp up, no current is flowing through the LEDs and hence no light is emitted. An initial value for the ramp up time can thus be obtained without any observable optical effect. Subsequently, the bypass switches can be made non-conducting to enter a 'normal operating mode' where light is being generated by the LEDs.

Advantageously this embodiment may provide for an adjustable ramp up lead-time. Furthermore, the ramp up lead-time may be adjusted rapidly over as little as two PWM cycles.

Figure 4:
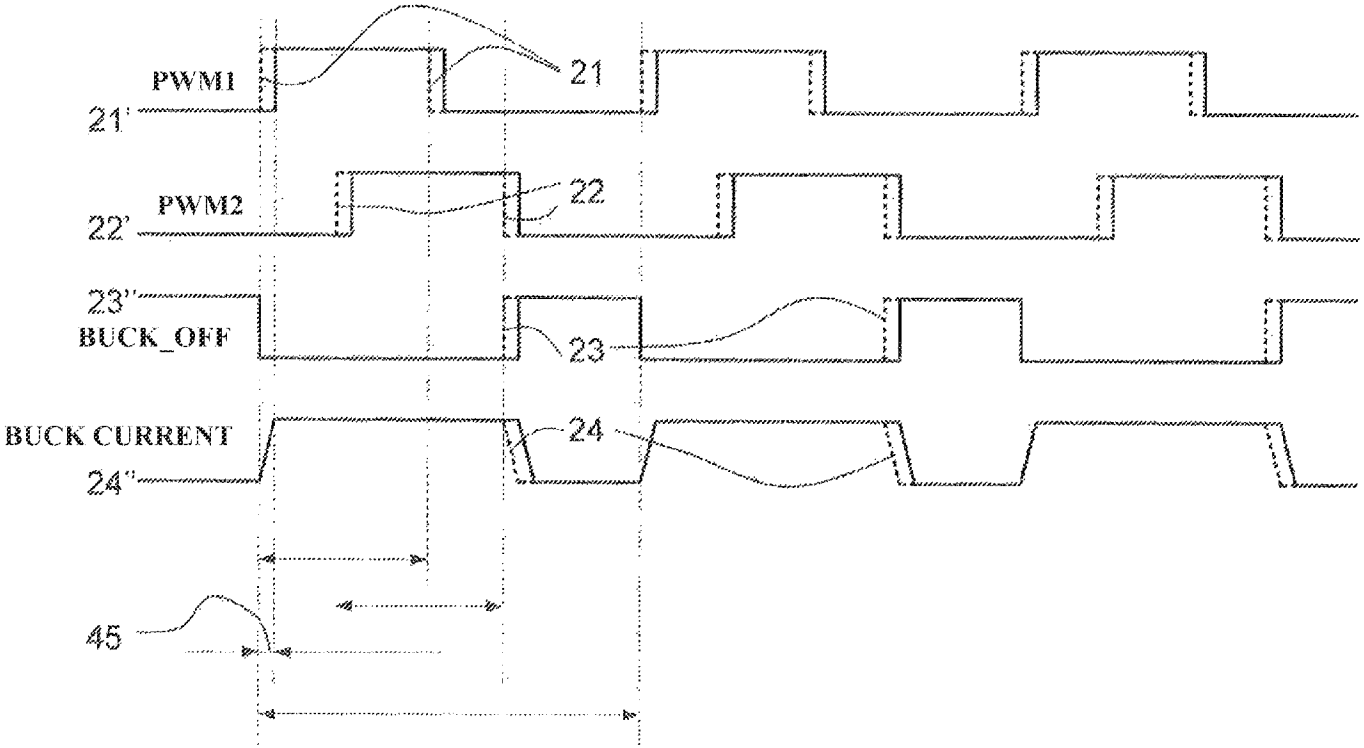
FIG. 4 illustrates the equivalent signals for a second embodiment of the present invention.

In an alternative embodiment the signals driving the bypass switch are delayed so that the control signal for switching off the current generator has a ramp up lead-time. This embodiment is illustrated in FIG. 4. FIG. 4 shows the drive signals 21 and 22 (dotted lines) for the bypass switches which have been delayed by a period 45 corresponding to the ramp up time to result in traces 21' and 22' (solid lines) respectively. The control signal 23" for switching off the current converter is shown (solid line) compared with the original control signal without a delay (dotted line 23). Note that in this embodiment the rising edge of the control signal 23" for switching off the current generator is delayed. This may be compared with the previous embodiment, in which the trailing edge of the signal is brought forward to an earlier time. In both embodiments, the period of time during which the current converter is off is reduced by a lead-time which is equivalent to the ramp-up time of the current converter. The current output 24" from the current converter according to this embodiment is also shown in FIG. 4. It may be seen that the current is not switched off until a point in time after that for the case with no adjustment (24, dotted line); the difference in these two moments being the lead-time equivalent to the ramp up time.

Advantageously this embodiment provides for an adjustable ramp up lead-time, without the initialisation difficulties associated with the previous embodiment. The lead-time adjustment to the ramp up can occur on a cycle-by-cycle basis.

An implementation method for either of these embodiments will now be described. The implementation involves four basic elements:

a) a means to monitor the ramp up of the LED current;

b) a means to determine the required ramp up lead-time;

c) a means to store the required ramp up lead-time, and d) a means to replicate the determined ramp up lead-time.

In order to implement element a), a sense resistor is provided. Typical implementations have a sense resistor for use by the current generator which requires to monitor and adjust its output. Thus, it is possible to use this same sense resistor for step (a), resulting either in a reduction, or no increase, in component count. The voltage across the sense resistor can easily be monitored to determine the ramp up of the current.

Implementation of elements b) and c) will be readily apparent to a person skilled in the art. The elements can be implemented either in a digital environment, or an analogue environment. A typical digital implementation is as follows: a clock and a counter are used. The clock runs at a fixed frequency and the counter is increased on each clock cycle (starting from a fixed base value such as zero) until the ramp up of the LED current is completed. With known clock frequency, the counter value is then a measure for the ramp up time. The counter value may be stored in a memory such as a register, which provides an implementation solution for element c).

Similarly analogue implementations will be readily apparent to the person skilled in the art. An example of an analogue implementation of elements b) and c) is as follows: this implementation uses a capacitor and a fixed current source. During the LED current ramp up time, the capacitor is charged with the fixed current from the fixed known current source. The voltage over the charged capacitor is then a measure for the ramp up lead-time, and provides an implementation for element b). In embodiments where only a single LED channel is being driven, this capacitor can also be used for the storage (as element c)). However, for a system such as that shown in FIGS. 3 and 4 with more than one LED channel, a separate storage element is required. This can be for instance a separate capacitor, or other means such as a digital register (storing a digital representation of the voltage over the capacitor), etc.

Figure 5:
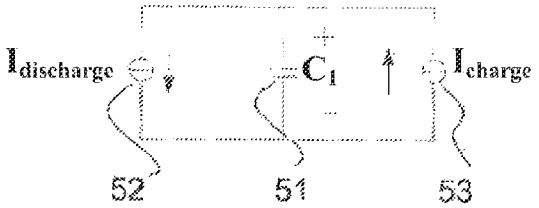
FIG. 5 is a block diagram of an analogue implementation of an embodiment of the present invention.

An example of the way a capacitor is used to provide elements b) and c) is shown in FIG. 5. FIG. 5 shows a capacitor 51 which may be charged with a current $I_{charge}$, 53, and discharged with a current $I_{discharge}$, 52. The charging current $I_{charge}$ obeys the following logic:

```
IF ((ChargeC1=HIGH) and (V_sense < V_hyst_top))
THEN I_charge= 1 uA
ELSE I_charge= 0 uA
END IF
```

Equivalently the discharge current $I_{discharge}$ obeys the following logic:

```
IF ((DischargC1=HIGH) AND (V_C1>0))
THEN I_discharge=1 uA
ELSE I_discharge=0 uA
END IF.
```

Thus, the sense capacitor is charged or discharged at a constant rate of 1 uA depending on the state of the circuit.

Figure 6:
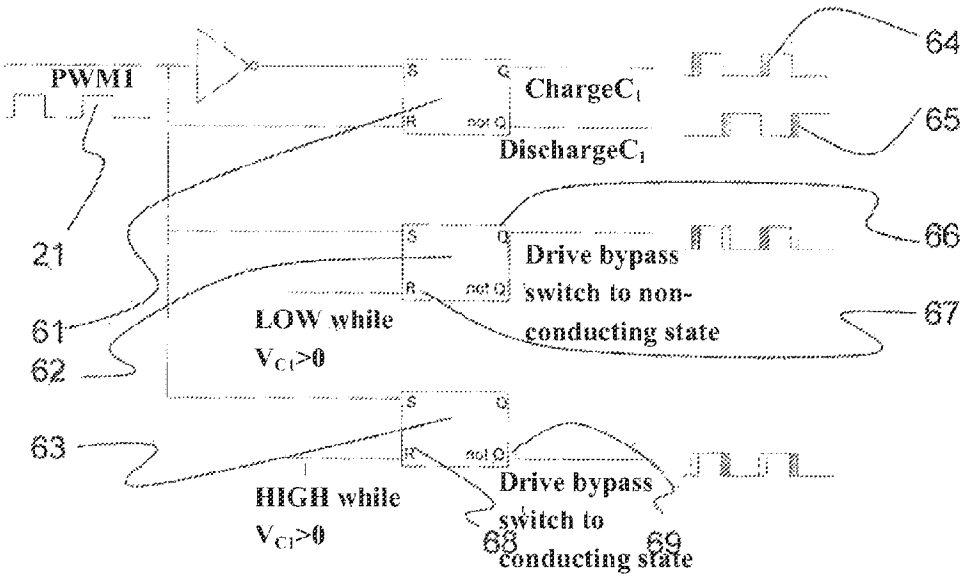
FIG. 6 is a logic diagram of the analogue implementation of FIG. 4.

The way the logic described above in relation to FIG. 5 effects a PWM signal is shown in FIG. 6. FIG. 6 depicts a PWM signal 21. Flip-flop 61 sets the charging or discharging of the Capacitor C1 (i.e. ChargeC1 is on the flip-flop Q output and DischargeC1 is on the not-Q output). From FIG. 6 it may be seen that charging the capacitor is started at the rising flank of the PWM signal 21. The bypass switch will only change its state after the LED current has reached its target value (and thus the ramp up lead time is complete), as shown at 64 on the ChargeC1 output. As soon as the PWM signal has a falling edge, discharging the same capacitor is started and the bypass switch will only change its state after the capacitor has been discharged completely as shown at 65. The second flip-flop 62 delays the bypass switch transition from conducting to non-conducting, thereby allowing the current to ramp-up (if needed). The reset input R (67) to this flip-flop is low while $V_{C1}>0$. The output Q (66) of this flip-flop provides the drive bypass switch to non-conducting state. The third flip-flop 63 has its reset 68 high while $V_{C1}>0$, and its not-Q output 69 to drive bypass switch to conducting state. This flip-flop thus delays the bypass switch transition from non-conducting to conducting to make sure that indeed the requested duty cycle is applied to the LED.

If more than one bypass switch per current channel is implemented, the voltage over the capacitor needs to be replicated multiple times in order to be able to delay second and subsequent PWM signals, and the control signal for the switch off of the current generator.

The embodiments above have been described in relation to LED current drivers and associated bypass switches. However the invention is equally applicable to other loads. A particular example of such an other load is an electroluminescent display, wherein the implementation of the embodiments would be to use voltage drivers along with circuit-breaker switches.

Figure 7:
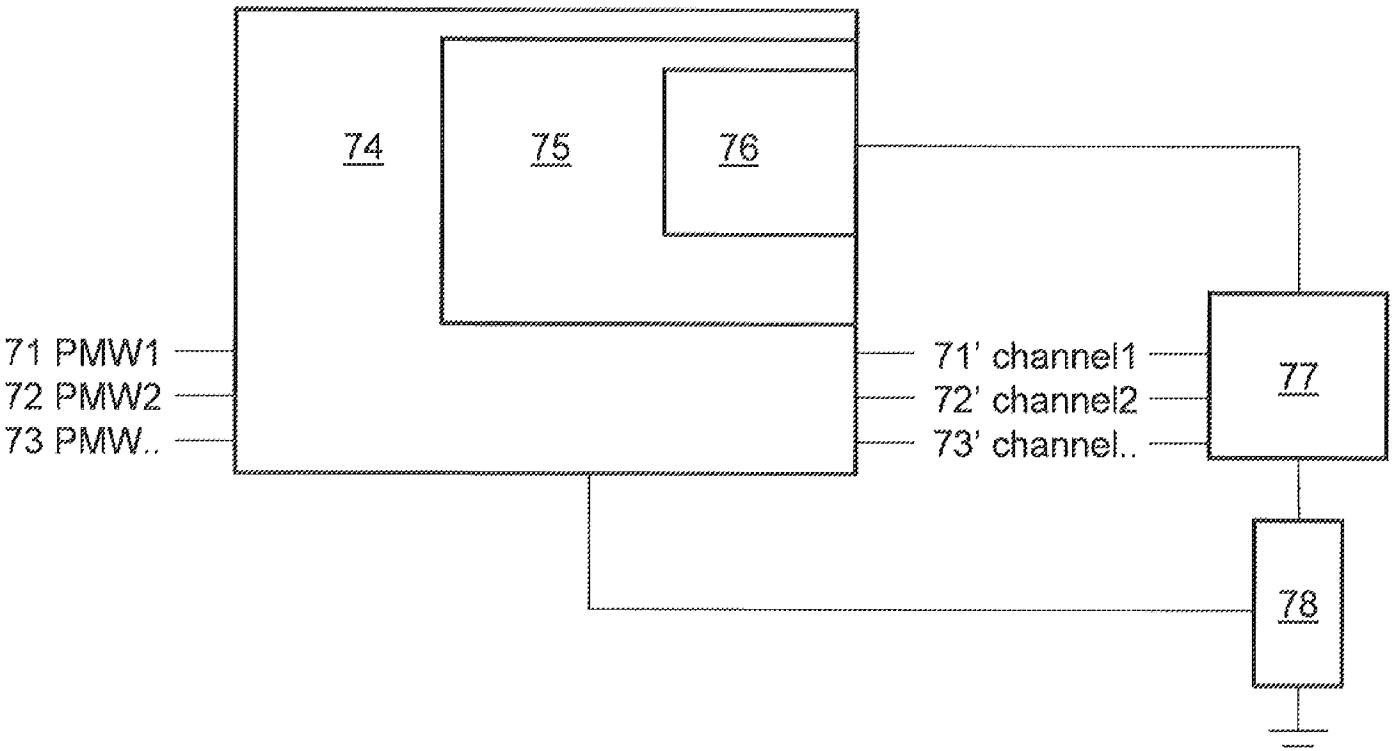
FIG. 7 is a schematic of a drive circuit as described.

FIG. 7 shows a schematic of a driver circuit according to an embodiment of the present invention. Power switches 76 are controlled by a first controller 75 (or first functional block of a composite controller). This controller regulates the—voltage or current—output to the desired level, and monitors the system to avoid potentially damaging, dangerous, or harmful conditions such as short-circuits. Further, it provides the functionality for generating the internal on-times and off-times t_on and t_off for each power switch. It is connected to a sense node 78 which provides sense data to effect at least some of these control functions.

The first controller 75 is, at least functionally, embedded within or partially embedded within a further controller 74. This further controller includes the functionality of determining when the power converter is switched on or off, generating the internal power converter on-off signals, and includes the function of automatically adjusting the ramp up lead-time by monitoring the sense node 78. The various PWM input signals 71, 72, 73 etc. are inputs to this further controller, and the channel signals 71', 72' 73', etc are output from this further controller, to the multi-channel output load 77.

In the embodiment comprising two controllers as illustratively discussed above, the controllers may each be implemented in hardware, or a mixture of hardware and software. Further, they may be separately packaged, or integrated into the same package, or integrated into the same semiconductor device, all within the scope of the invention. Further, the functionality of the two controllers may be interchanged partly or completely, or combined into a single controller.

From reading the present disclosure, other variations and modifications will be apparent to the skilled person. Such variations and modifications may involve equivalent and other features which are already known in the art of controllers for power generators, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination.

The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, and reference signs in the claims shall not be construed as limiting the scope of the claims.

The invention claimed is:

1. A method of operating a controller, the controller being for controlling a power generator circuit for supplying power to a pulse modulated signal, the pulse modulated signal being for driving a load, the load being switchable with a switch, which controller has a cycle with a period corresponding to the sum of an off-time and an on-time, the power generator circuit being arranged to start to switch off at the start of the off-time, and to start to switch on at the start of the on-time, the method comprising the steps of:

(a) monitoring a rate of change of output power of the power generator circuit at a time when it is ramping up from an off-state to an on-state, (b) determining a lead-time from the rate of change of output power, (c) storing the determined lead-time, and (d) adjusting at least one of the off-time and the on-time of the controller in dependence on the stored lead-time.

2. A method according to claim 1, wherein the power generator is a voltage generator, wherein step (a) comprises monitoring a rate of change of output voltage, and wherein the switch comprises a circuit-breaker switch.

3. A method according to claim 1, wherein the power generator is a current generator, wherein step (a) comprises monitoring a rate of change of output current, and wherein the switch comprises a by-pass switch.

4. A method according to claim 3, wherein the load is an LED.

5. A method according to claim 3, wherein step (a) comprises monitoring a voltage across a sense resistor.

6. A method as claimed in claim 3, wherein the off-time initially is related to a no-load time, which no-load time is the time during which the pulse modulated signal is off such that the load is zero.

7. A method as claimed in claim 6, wherein the off-time initially corresponds to the no-load time.

8. A method as claimed in claim 6, wherein the off-time initially corresponds to the no-load time reduced by a predetermined default lead-time.

9. A method as claimed in claim 3, wherein in step (b) the lead-time is determined by dividing a predetermined operating current level by the rate of change of current.

10. A method as claimed in claim 3, wherein step (d) comprises advancing the start of the on-time in dependence on the stored lead-time.

11. A method as claimed in claim 10, wherein step (d) comprises advancing the start of the on-time by the stored lead-time.

12. A method as claimed in claim 3, wherein step (d) comprises delaying the start of the off-time in dependence on the stored lead-time and further comprises delaying the switching of the bypass switch in dependence on the stored lead-time.

13. A method as claimed in claim 12, wherein step (d) comprises delaying the start of the off-time by the stored lead-time and further comprises delaying the switching of the bypass switch by the stored lead-time.

14. A method as claimed in claim 1, wherein step (b) comprises increasing a counter from a base value, by means of a clock running at a fixed frequency, throughout the period of ramp-up from the off-state to the on-state, and step (c) comprises storing a value determined from the counter value in a memory.

15. A method as claimed in claim 1, wherein step (b) comprises charging a first capacitor from a predetermined current source.

16. A method as claimed in claim 15, wherein step (c) comprises storing, in the first or a further capacitor, the charge in the first capacitor resulting from step (b).

17. A method as claimed in claim 15, wherein step (c) comprises storing, in a digital register, a signal which relates to the charge in the first capacitor resulting from step (b).

18. An integrated circuit for controlling a power generating circuit, comprising a controller configured to operate the method according to claim 1.

19. An integrated circuit as claimed in claim 18, further comprising a power generating circuit for supplying power to the pulse modulated signal.

20. An LED driver comprising an integrated circuit as claimed in claim 18.

* * * * *